United States Patent [19]

Sack et al.

[11] Patent Number: 4,665,013

[45] Date of Patent: May 12, 1987

[54] PHOTOGRAPHIC SUPPORT MATERIALS CONTAINING COATED PIGMENT

[75] Inventors: Wieland Sack, Bissendorf; Reiner Anthonsen, Bramsche, both of Fed. Rep. of Germany

[73] Assignee: Felix Schoeller Jr. GmbH & Co. KG, Osnabrück, Fed. Rep. of Germany

[21] Appl. No.: 769,665

[22] Filed: Aug. 26, 1985

[30] Foreign Application Priority Data

Sep. 28, 1984 [DE] Fed. Rep. of Germany ..... 3435639

[51] Int. Cl.[4] ..... G03C 1/94

[52] U.S. Cl. ..... 430/532; 430/523; 430/538; 430/935; 430/942; 427/44; 427/362; 428/323; 428/481; 428/403; 428/404

[58] Field of Search ..... 430/538, 532, 935, 942, 430/523; 427/44, 362; 428/323, , 481, 400, 404

[56] References Cited

U.S. PATENT DOCUMENTS 4,364,971 12/1982 Sack et al. ..... 427/362
4,384,040 5/1983 von Meer ..... 430/538

*Primary Examiner*—Jack P. Brammer
*Attorney, Agent, or Firm*—Lockwood, Alex, Fitzgibbon & Cummings

[57] ABSTRACT

Described is a photographic support material for black-and-white and color photographic emulsions, which support material is coated at least on one side with a layer containing a white pigment ad a binder component that predominantly includes unsaturated organic compounds and that is hardened by means of high energy radiation, while the white pigment, which is preferably a titanium oxide or titanium mixed oxide, carries an inorganic surface deposit which consists of oxides or hydrated oxides that make up at least about 2% by weight of the total pigment. The oxides and hydrated oxides include those of aluminum, silicon, zinc, magnesium, tin, zirconium, antimony or alkaline-earth metals.

13 Claims, No Drawings

PHOTOGRAPHIC SUPPORT MATERIALS CONTAINING COATED PIGMENT

DESCRIPTION

BACKGROUND OF THE INVENTION

The invention concerns a support material for black-and-white or color photographic emulsions, the support material being of the type that includes at least one coating hardened by means of electron radiation.

A number of support materials for photographic emulsions are known. Among the most common supports are film materials and papers. Papers usually have extra coatings. Watertight papers coated with layers of synthetic resin in particular are widely used as supports for photographic emulsions. Synthetic films and laminates with special coatings are also known. The most widely used have been papers that are coated on both sides with polyolefin resins and film materials that are coated with pigmented layers, such being described, for example, in DE-AS No. 14 47 815, U.S. Pat. No. 3,833,380, U.S. Pat. No. 3,630,742 and U.S. Pat. No. 3,928,037. However, such coatings have only a limited pigment capacity, are not scratch-proof and are not suitable for thermal image development. Considerably improved paper supports consisting of base paper with at least one coating produced in situ by means of electron radiation hardening are described in DE-OS No. 30 22 451 and DE-OS No. 30 22 709. The advantages of a coating hardened with electron radiation are its resistance to scratching, its high pigment acceptance capacity and its enhanced surface sheen in comparison with polyolefin coatings.

Synthetic resin coatings are resistant not only to water, but also to acid and alkaline photographic processing solutions to thereby prevent the penetration of these solutions to paper supports underneath them. Consequently, in the case of paper or unwoven material bases, the time-consuming washing operation is decisively shortened.

All resin coatings, whether on paper or on film, can contain pigments, dyes, optical brighteners, image stabilizers, antioxidants, or other additives, to the extent that each may be desirable or necessary with respect to the desired characteristics of the image to be formed on the support material. Of the possible additives, pigments and dyes are the most important for the visual impression of a photographic image on the coating. In the case of color images, they determine the color character and are decisive for the sharpness of the photographic images.

The photographic emulsions, after appropriate pretreatment of the resin surface, are applied directly to the surface of the resin layer or they are applied after the application of an adhesion-promoting intermediate coating to the surface of the resin layer. These photographic emulsions are preferably those known under the concept of silver salt photography and can be used to produce black-and-white or color images.

Resin coatings hardened with electron radiation according to DE-OS No. 30 22 451 or DE-OS No. 30 22 709 are produced by the uniform application of a flowable mixture to the surface of a paper or other base support and subsequent hardening with high-energy electron radiation under a buffer gas or some other shielding agent. The mixtures contain as the decisive constituent at least one substance with ethylenically unsaturated double bonds which have the capability to undergo a polymerizing reaction when it is triggered by radiation.

Although the electron radiation-hardened coatings have many advantages compared with polyolefin coatings, they still are limited by many drawbacks. Despite the great variety in the composition of radiation-hardened coatings, it has not been possible to produce a coating that behaves uniformly well in all photographic processing solutions. Rather, it has been shown that coatings hardened with electron radiation behave differently with different processing solutions. There are commercially available color developing preparations which, under the subsequent influence of oxygen, lead to a yellowish discoloration of the surface of the radiation-hardened coating. This discoloration is admittedly slight, but it is clearly visible and cannot be prevented by either the stop bath or thorough washing. Such discoloration occurs mainly with the use of photographic developing solutions containing an aromatic amine derivate, such as derivates of phenylene diamine, toluidine, and the like. Consequently, the use of papers with radiation-hardened coatings has been limited heretofore to processes in which other chemicals are used for image development, such as, for example, hydroquinone.

This yellowing by color developers does not occur in the case of polyolefin surfaces that contain rutile or anatase or another white pigment, nor does it occur in conventional baryta papers having at least one coating consisting essentially of barium sulfate and gelatine. Other coatings consisting of different synthetic resins and white pigment also do not show this coloration, while heretofore described radiation-hardened coating based on acrylates, methacrylates or allyl compounds are always visibly discolored with color developers. Accordingly, the composition of the binder component seems to be decisive for the discoloration with developers, especially a binder component having the possible presence of unsaturated organic compounds.

The discoloration of radiation-hardened coatings by color developers shows up in both pigment-free coatings and coatings that contain white pigment. As a rule, the discoloration in pigment-containing coatings is even greater than in pigment-free coatings, as shown in Table 1 below, which reports discoloration data for binders that included 62% by weight of polyester tetraacrylate, 22.5% by weight of glycerin propoxytriacrylate, and 15.5% by weight of hexandioldiacrylate.

TABLE 1

Coating discoloration by color developers

| | Discoloration |
|---|---|
| Layer without pigment | 0.05 |
| Layer with 20% by weight $BaSO_4$ | 0.10 |
| Layer with 20% by weight ZnS | 0.11 |
| Layer with 20% by weight $CaCO_3$, type 1 | 0.09 |
| Layer with 20% by weight $CaCO_3$, type 2 | 0.075 |
| Layer with 20% by weight $TiO_2$ (anatase) | 0.08 |
| Layer with 20% by weight $TiO_2$ (rutile 1) | 0.06 |
| Layer with 20% by weight $TiO_2$ (rutile 2) | 0.07 |
| Layer with 20% by weight Zn—titanate | 0.65 |
| Layer with 20% by weight $Al_2O_3$ | 0.075 |
| Layer with 20% by weight AlO (OH) | 0.08 |
| Layer with 20% by weight $SiO_2$ | 0.065 |
| Layer with 20% by weight MgO | 0.06 |
| Layer with 20% by weight ZnO | 0.085 |

Copending U.S. patent application Ser. No. 722,732, filed Apr. 11, 1985, revealed a way to obtain coatings with diminished discoloring by using special compositions of the hardenable components of a coating mixture. The procedure described therein is based on the fact that unsaturated hydroxyfunctional compounds are contained in a molar concentration of 2 or greater in the coating mixtures. The technical principle of this approach is basically applicable to both pigment-free and pigmented coating mixtures. Certainly, pigment-containing coating mixtures as a rule are discolored somewhat more than pigment-free coatings. Therefore, the OH-concentration in pigmented coating should be slightly greater than in comparable pigment-free coatings.

The disadvantage of the solution provided by this copending application, however, is the greatly limited choice of usable mixture components. This disadvantage becomes especially apparent in the case of highly pigmented coatings which, in order to avoid undesirable brittleness with increasing pigment content, require an increasing quantity of flexibilizing additives.

It is therefore an object of the present invention to provide a radiation-hardened coating layer which provides an exceptionally versatile application of the coated support which, even after usual treatment with commercially available color developers, shows little or no discoloration.

This object is achieved by using as white pigment a titanium dioxide that has an inorganic surface coating which constitutes at least 2% by weight of total pigment.

Titanium dioxide pigments used in coatings can be untreated like the $TiO_2$ (rutile 2) listed in Table 1. Frequently, however, for improvement of their dispersability, they are given a surface aftertreatment; that is, they are coated with inorganic oxides such as $Al_2O_3$, AlO(OH), $SiO_2$, ZnO and others. Here, hydrated oxides are also to be understood to be included under the term oxides in its broader sense. Such surface-coated types are, for example, the $TiO_2$ (anatase) and $TiO_2$ (rutile 1) listed in Table 1 which are coated with 0.6% and 1.0% by weight, respectively, of aluminum oxide and, like the other white pigments of Table 1, lead to increased discoloration with color developer. Even the use of titanium dioxides that are thus treated or that also are surface coated with organic substances does not lead to a decrease in the discoloration with a color developer unless OH-containing compounds as indicated in the copending application are present at the same time.

DESCRIPTION OF PREFERRED EMBODIMENTS

Discoloration with a color developer is clearly reduced when a titanium dioxide is used that is surface coated with 2% by weight or more than 2% by weight of an inorganic oxide or hydrated oxide. The inorganic oxide or hydrated oxide can be, for example, an aluminum oxide, silicic acid, zinc oxide, magnesium oxide, tin oxide, zirconium oxide, antimony oxide or one of the alkaline earth metal oxides or mixtures of such compounds. Because of the surface coating, the titanium dioxide particles are provided with a more or less compact coating of the inorganic oxide or hydrated oxide. The coating can consist of one or more layers and contain still other oxides in addition to those named, insofar as these are not color-producing.

Such coated titanium dioxide pigments can be produced by any desired method. They can also be present under the surface coating as mixed oxides with another white oxide, and they can further be treated in any desired way with organic compounds. What is especially important is that the pigment particles contain a sufficiently thick coating of an inorganic oxide or hydrated oxide other than $TiO_2$.

Surface coatings including titanium dioxide pigment with different inorganic coatings are described in *Titanium* by J. Barksdale (New York, 1966), as well as in various patents and patent applications. Japanese Patent Disclosure No. 57-108849/1982 specified the use of titanium dioxide aftertreated with 0.2 to 1.2% by weight of hydrated aluminum oxide in polyolefin coatings on photographic papers. It is, however, surprising that titanium oxide pigments that are coated with 2 or more % by weight of any white oxides or hydrated oxides have in radiation-hardened coating mixtures an especially favorable effect on the coloring of the hardened coating layer with photographic color developer. This is all the more surprising in that the corresponding oxides and hydrated oxides lead to an enhanced discoloration when used alone in radiation-hardened layers (see, for example, Table 1).

The advantages of the use according to the invention of titanium oxide pigments with 2 or more % by weight of other oxide or hydrated oxide coatings in radiation-hardened layers are seen both in layers that are hardened by means of electron radiation and in layers of otherwise hardened unsaturated starting components. The coating layers can be on paper, film, metal foil, laminated paper or any other support, and they may contain other additives.

In a particular embodiment of the invention, use is made of titanium oxide pigment with a surface coating that consists largely or even predominantly of silicic acid. In addition, a small amount of an aluminum oxide and/or zinc oxide and/or antimony oxide and/or zirconium oxide and/or alkaline-earth oxide can be present. At the same time, whether the covering of the $TiO_2$ is more or less compact is of secondary importance. What is more important is the degree of coating.

An additional organic surface coating may be included to produce its known advantages even in inorganic oxide-coated titanium dioxide pigments. Exemplary additional coatings include polyvalent alcohol, (poly)siloxane, organic titanates, organophosphates, lactone, amino compounds, and other substances which in general improve dispersability.

When the term titanium dioxide pigments is used in the sense of this invention, it is to be understood to include not only the known $TiO_2$ modifications known as rutile and anatase, but also other pure or mixed titanium oxides as well as white pigment-like titanates.

It can be especially advantageous if titanium dioxide that is surface-coated with at least 2% by weight of another oxide in accordance with this invention is used in a hardenable mixture containing hydroxyfunctional unsaturated substances. The special advantage of this combination is that the molar concentration of the hydroxy groups in the mixture can definitely be smaller than 2 and that nevertheless layers can be obtained that show no visible coloring with color developer. The invention is especially advantageous when the electron radiation-hardenable substances are mixtures that contain at least one substance that contains two or more double bonds. In addition, however, non-reactive substances without double bonds can be contained in these mixtures to a limited extent.

Substances containing acrylate or methacrylate groups are typically used as the reactive components.

But esters of malic acid, fumaric acid, mesaconic acid, citraconic acid or itaconic acid, other derivatives of these acids, allyl compounds, as well as linear and cyclical dienes or trienes, can also serve as reactive mixture components. Preferred are the esters of these acids which are derived from polyvalent alcohols. Examples are hexane diol diacrylate, trimethylol propane triacrylate, polyester acrylates, polyurethane acrylates, polyether acrylates, polyepoxy diacrylates, alkyd resin acrylates, or the methacrylates corresponding to these acrylates.

The rheological properties of such hardenable mixtures are adjusted according to the invention by mixing constituents of higher molecular weight with low molecular weight substances. The hardness and flexibility of the hardened layers is determined by the ratio of double bonds to molecular magnitudes present in the starting material and can be varied within wide limits by mixtures of different substances with each other.

Support materials according to the invention are suitable as supports for all known photographic emulsions containing at least one silver compound. They are particularly suitable both for all wet development processes and for thermal image development processes.

The following examples explain the principles of the invention in greater detail.

EXAMPLE I

A mixture of 62% by weight of polyester tetraacrylate having a molecular weight of about 1000, 22.5% by weight of glycerin proproxytriacrylate and 15.5% by weight of hexane diol diacrylate was evenly applied, on the one hand, without addition of pigment and, on the other hand, with addition of 20% by weight of titanium oxide pigment with 2 or more % by weight of an inorganic surface coating, to a polyethylene/paper laminate and hardened by electron radiation. The hardened coating had in each case a thickness of about 20 μm.

The coatings were then treated with commercially available photographic developer for color paper and washed, and the samples were stored for four days at room temperature and in the presence of air. The discoloration of the coating surface that occurred during this storage was determined according to DIN 4512 as a change in the optical density compared with the starting value. These data are given in Table 2.

TABLE 2

Type of pigment in the layers and discoloration of the coatings from Example I

| Experiment | Type of pigment | Discoloration |
|---|---|---|
| 1 a | without addition of pigment | 0.05 |
| 1 b | rutile coated with 2% Al oxide | 0.045 |
| 1 c | rutile coated with 3% Al oxide | 0.04 |
| 1 d | rutile coated with 5% Al oxide | 0.035 |
| 1 e | rutile coated with 4% AlSi oxide | 0.035 |
| 1 f | rutile coated with 10% AlSi oxide | 0.02 |
| 1 g | rutile coated with 14% AlSi oxide | 0.015 |
| 1 h | rutile coated with 17% AlSi oxide | 0.015 |
| 1 i | rutile coated with 6% MgSi oxide | 0.03 |
| 1 k | rutile coated with 6% AlZn oxide | 0.03 |
| 1 l | rutile coated with 8% AlZn oxide | 0.025 |
| 1 m | rutile coated with 6% AlSi oxide | 0.035 |
| 1 n | anatase coated with 2.3% Al oxide | 0.045 |
| 1 o | anatase coated with 4% AlSi oxide | 0.04 |
| 1 p | anatase coated with 10% AlSi oxide | 0.025 |
| 1 q | anatase coated with 8% AlZrSi oxide | 0.03 |
| 1 r | anatase coated with 6% AlMnSi oxide | 0.035 |
| 1 s | anatase coated with 5% AlP oxide | 0.035 |

TABLE 2-continued

Type of pigment in the layers and discoloration of the coatings from Example I

| Experiment | Type of pigment | Discoloration |
|---|---|---|
| 1 t | Mg titanate coated with 6% AlSi oxide | 0.03 |

These data show that the discoloration of the layer can be decreased by titanium oxide pigments with 2% by weight and more than 2% by weight of the other oxide coating. Experiment 1a serves as a control, and the other experiments show the decrease in discoloration with increasing coating weight.

EXAMPLE II

A basic mixture of 50% by weight of tripropylene glycol acrylate, 45% by weight of trimethylol propane triacrylate and 5% by weight of glycidyl methacrylate was applied, on the one hand, without addition of pigment (experiment 2a) and, on the other hand, with the addition of 30% by weight of titanium oxide pigment (experiment 2b), to a photographic base paper, evened out by means of a doctor blade to a thickness of on the order of about 35 μm and hardened in a known manner by means of electron radiation. The coatings were treated with color developer as in Example 1, and the discoloration was determined. The results are shown in Table 3.

TABLE 3

Type of pigment in the coatings and discoloration of the coatings of Example II

| Experiment | Type of Pigment | Discoloration |
|---|---|---|
| 2 a | without pigment | 0.10 |
| 2 b | rutile, treated organically only | 0.13 |
| 2 c | rutile, coated with 1% Al oxide | 0.11 |
| 2 d | anatase coated with 0.6% Al oxide | 0.12 |
| 2 e | rutile coated with 2% Al oxide | 0.08 |
| 2 f | rutile coated with 5% Al oxide | 0.065 |
| 2 g | rutile coated with 4% AlSi oxide | 0.06 |
| 2 h | rutile coated with 14% AlSi oxide | 0.02 |
| 2 i | rutile coated with 6% AlZnSi oxide | 0.05 |
| 2 k | rutile coated with 6% ZnSi oxide | 0.05 |
| 2 l | rutile coated with 6% ZrSi oxide | 0.055 |
| 2 m | rutile coated with 6% AlZr oxide | 0.06 |
| 2 n | rutile coated with 5% AlP oxide | 0.05 |
| 2 o | anatase coated with 4% AlSi oxide | 0.065 |
| 2 p | anatase coated with 10% AlSi oxide | 0.035 |
| 2 q | anatase coated with 6% AlMnSi oxide | 0.055 |
| 2 r | anatase coated with 8% AlZrSi oxide | 0.05 |
| 2 s | anatase coated with 5% AlP oxide | 0.055 |
| 2 t | anatase coated with 6% AlSi oxide | 0.05 |

These data, too, confirm that the discoloration caused by color developer is decreased by those titanium oxide pigments that contain at least 2% by weight of the other oxide coating. Even in the case of a coating that is strongly colored as a result of the addition of glycidyl methacrylate, the discoloration can be so greatly reduced by a heavier coating of the titanium oxide surface that the layer appears almost white (experiments 2h and 2p). Within the scope of the invention, it is important to note that here, too, the turning point with respect to the control of discoloration is a coating of 2% by weight.

EXAMPLE III

A basic mixture of 45% by weight of pentaerythritol triacrylate, 50% by weight of triethylene glycol diacrylate and 5% by weight of hydroxyethylacrylate was, as in Example I, applied uniformly, on the one hand, without addition of pigment, and on the other hand, with addition of 40% by weight of various titanium oxide pigments, to a polyethylene/paper laminate and hardened by means of electron radiation. The hardened coating had in each case had a thickness of on the order of about 20 μm. The OH-molarity of the basic mixture was 2. The coatings were tested as in Example I. The test results are given in Table 4.

TABLE 4

Pigments in the coatings and discoloration of the coatings of Example III

| Experiment | Type of pigment | Discoloration |
|---|---|---|
| 3 a | without pigment | 0.025 |
| 3 b | rutile coated with 1% Al oxide | 0.03 |
| 3 c | rutile coated with 2% Al oxide | 0.02 |
| 3 d | rutile coated with 5% Al oxide | 0.018 |
| 3 e | rutile coated with 4% AlSi oxide | 0.02 |
| 3 f | rutile coated with 14% AlSi oxide | 0.00 |
| 3 g | rutile coated with 6% AlZnSi oxide | 0.015 |
| 3 h | anatase coated with 4% AlSi oxide | 0.02 |
| 3 i | anatase coated with 10% AlSi oxide | 0.003 |
| 3 k | anatase coated with 8% AlZrSi oxide | 0.005 |
| 3 l | Mg titanate coated with 6% AlSi oxide | 0.015 |

This series of experiments, in which hydroxyfunctional hardenable components were used, confirms the advantage of using titanium oxides with another oxide coating of at least 2% by weight. At the same time, this series shows the special advantage of the combination of hydroxyfunctional hardenable substances together with an oxide-coated titanium oxide with at least a 2% coating.

What we claim is:

1. Photographic support material for black-and-white and color photographic emulsions comprising:

support material including a substrate having on at least one side a coating including a pigment material and a binder component, said binder component being produced from a composition containing at least one unsaturated compound, the double bonds of which undero a polymerizing reaction to be hardened by means of high energy ionizing radiation, said pigment material includes a white pigment selected from the group consisting of titanium dioxide, a titanium mixed oxide, or a white pigment-like titanate, said white pigment having an inorganic surface coating different from said white pigment, said inorganic surface coating of the white pigment includes an oxide or hydrated oxide of aluminum, silicon, zinc, magnesium, tin, zirconium, antimony or an alkaline earth metal, or mixtures of these oxides and hydrated oxides, and said inorganic surface coating accounts for at least about 2% by weight of the total pigment material.

2. The support material according to claim 1, wherein the inorganic surface coating accounts for between about 3 and 20% by weight of the total pigment material.

3. The support material according to claim 1, wherein said pigment material is a titanium dioxide white pigment surface, said inorganic surface coating thereover is another oxide, and said pigment material is worked into a hardenable binder component which contains hydroxyfunctional substances.

4. The support material according to claim 2, wherein said pigment material is a titanium dioxide white pigment surface, said inorganic surface coating thereover is another oxide, and said pigment material is worked into a hardenable binder component which contains hydroxyfunctional substances.

5. The support material according to claim 1, wherein said inorganic surface coating consists predominantly of silicic acid.

6. The support material according to claim 2, wherein said inorganic surface coating consists predominantly of silicic acid.

7. The support material according to claim 3, wherein said inorganic surface coating includes silicic acid and an oxide of aluminum, zinc, antimony, zirconium, or an alkaline earth metal.

8. The support material according to claim 1, wherein said binder component includes at least one substance that contains two or more double bonds.

9. The support material according to claim 2, wherein said binder component includes at least one substance that contains two or more double bonds.

10. The support material according to claim 3, wherein said binder component includes at least one substance that contains two or more double bonds.

11. The support material according to claim 5, wherein said binder component includes at least one substance that contains two or more double bonds.

12. The support material according to claim 1, wherein the photographic support material is intended for use with a photographic emulsion that contains at least one inorganic or organic silver compound.

13. The support material according to claim 1, wherein the photographic support material is intended for use with photographic black-and-white or color emulsions that are heat developable.

* * * * *